US006621989B2

(12) United States Patent
Otomo et al.

(10) Patent No.: US 6,621,989 B2
(45) Date of Patent: Sep. 16, 2003

(54) IMAGE FORMING APPARATUS AND A UNIT DETACHABLY MOUNTABLE ON AN IMAGE FORMING APPARATUS COMPRISING MEANS FOR DETECTING THE AMOUNT OF DEVELOPER CONTAINED IN A DEVELOPER CONTAINER

(75) Inventors: Yasunao Otomo, Numazu (JP); Takashi Hibi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/771,570

(22) Filed: Jan. 30, 2001

(65) Prior Publication Data

US 2001/0028802 A1 Oct. 11, 2001

(30) Foreign Application Priority Data

Feb. 1, 2000 (JP) ..... 2000-024053

(51) Int. Cl.[7] ..... G03G 15/06; G03G 15/08

(52) U.S. Cl. ..... 399/27; 399/30

(58) Field of Search ..... 399/25, 27, 29, 399/30, 59, 24

(56) References Cited

U.S. PATENT DOCUMENTS 4,932,356 A * 6/1990 Watanabe et al. ..... 399/30 X
4,956,668 A * 9/1990 Arnold et al. ..... 399/59
4,961,088 A * 10/1990 Gilliland et al. ..... 399/25
5,012,286 A * 4/1991 Kawano et al. ..... 399/59
5,095,335 A 3/1992 Watanabe et al. ..... 355/210
5,126,800 A 6/1992 Shishido et al. ..... 355/211
5,710,956 A * 1/1998 Kurohata et al. ..... 399/24
5,802,419 A * 9/1998 Sakurai et al. ..... 399/27 X
5,835,818 A 11/1998 Hoshika et al. ..... 399/26
5,923,917 A * 7/1999 Sakurai et al. ..... 399/27
5,946,522 A * 8/1999 Inami ..... 399/27

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes a developer container for containing a developer, a developer amount detector for detecting the amount of the developer contained in the developer container, a correcting device for correcting the detected value detected by the developer amount detector, and a memory. At least the developer container and the memory are disposed in a unit and the unit is detachably mountable on a main assembly of the image forming apparatus. The memory stores information indicating that the unit is new. The correcting device corrects a next detected value to be detected by the developer amount detector according to the detected value detected by the developer amount detector when the developer amount detector detects information indicating that the unit is new.

22 Claims, 10 Drawing Sheets

IMAGE FORMING APPARATUS AND A UNIT DETACHABLY MOUNTABLE ON AN IMAGE FORMING APPARATUS COMPRISING MEANS FOR DETECTING THE AMOUNT OF DEVELOPER CONTAINED IN A DEVELOPER CONTAINER

BACKGROUND OF THE INVENTION

1. Field of the Invention

The present invention relates to image forming apparatuses such as a copier and a printer and a cartridge detachably mountable on the image forming apparatus, and particularly to an image forming apparatus in which a residual amount of a developer can accurately be detected and a cartridge detachably mountable on the image forming apparatus.

2. Description of the Related Art

As one example of an image forming apparatus, in electrophotographic image forming apparatuses such as an electrophotographic copier and a laser beam printer, an electrophotographic photosensitive member as an image bearer is irradiated with light corresponding to image information to form a latent image, a developer is supplied to the latent image by developing means to develop the image, and further the image is transferred to a recording sheet from the photosensitive member so that the image is formed on the recording sheet.

The developing means is provided with a developer container, and the developer in the developer container is consumed by forming the image.

In such conventional image forming apparatus in which an electrophotographic image forming process is used, a process-cartridge system is employed in which an electrophotographic photosensitive member, and process means acting on the electrophotographic photosensitive member, that is, charging means and developing means are unified in a cartridge, and the cartridge is detachably mountable on a main assembly of the electrophotographic image forming apparatus. According to the process-cartridge system, since maintenance of the apparatus can be performed by a user without depending on a serviceman, operability can remarkably be enhanced. Therefore, the process-cartridge system is broadly used in the electrophotographic image forming apparatus.

In the electrophotographic image forming apparatus of the process-cartridge system, when the developer is used up, the image can be formed again by changing the cartridge. However, the cartridge has to be changed by the user, and this requires means for informing the user that the developer has been consumed, that is, a developer-amount detector.

For the developer-amount detector, in order to make it possible to know the residual amount of the developer usable for image formation in the cartridge at any time, a developer-residual-amount-pick-up part, which can pick up a signal of a developer-residual-amount level, is disposed in the cartridge or the image forming apparatus main assembly.

As one type of this developer-residual-amount-pick-up part, a flat antenna type is used. In a plane antenna, as shown in FIG. 3, a pair of conductive patterns 22, 23 are formed at a predetermined interval on a substrate 21, and the antenna is disposed, for example, in a position of the side surface of the developer container such that the antenna is in contact with the developer. When the developer in the developer container decreases, the contact area of the developer with a plane antenna 20 decreases.

When the developer is consumed, the contact area of the surface of the conductive pattern with the developer changes, and this also changes the electrostatic capacity. It is therefore possible to establish a correspondence between the residual amount of the developer in the container and the electrostatic capacity of the plane antenna. When the electrostatic capacity of the plane antenna is measured, the residual amount of the developer in the container can be known at any time.

When a constant alternating-current bias is applied to one of the pair of conductors 22, 23, the electrostatic capacity of the plane antenna 20 can be known from a current flowing through the other conductor.

In practice, even when the developer in the developer container gradually decreases, a slight amount of remaining developer sticks to the surface of the plane antenna 20. Therefore, an antenna cleaning member is attached to an agitating member disposed in the developer container, and the surface of the plane antenna is cleaned with rotation of the agitating member.

However, when the antenna surface is cleaned in this manner, an output of the plane antenna 20 fluctuates with a period in which the antenna surface is cleaned by the cleaning member. Therefore, the developer-residual-amount level is defined by taking an average value in accordance with the period, selecting a minimum value, or performing another statistical processing operation.

However, even when the developer-residual-amount-pick-up part 20 capable of picking up a signal of the developer residual amount is disposed, the value detected by the developer-residual-amount-pick-up part and the amount of the developer remaining in a developing device cannot accurately be detected in some cases.

For example, for the electrostatic capacity of the plane antenna 20, and the positional relation between two electrodes (conductive patterns 22, 23), even in a case in which there is no developer, the closer to each other the electrodes are, the larger the absolute value of the electrostatic capacity becomes, The farther from each other the electrodes are, the smaller the absolute value becomes. That is to say, the antenna output is influenced by an antenna manufacturing tolerance. When the developer-residual amount is detected only with the antenna output, the detected amount sometimes becomes far different from the actual residual amount of the developer. Moreover, because of not only the process cartridge but also the image-forming-apparatus main assembly, the detected electrostatic capacity value is caused to sometimes become different from the actual value.

Therefore, in a conventional art, when a detected electrostatic capacity value of a point at which the container is full of the developer is larger than an initially set (assumed) value, the developer-residual amount is estimated more than the actual amount. Thereby, the developer is used up before a warning is issued, and a null image is frequently formed. Conversely, when the detected electrostatic capacity value of the point at which the container is full of the developer is smaller than the initially set (assumed) value, the developer-residual amount is estimated to be less than the actual amount. In this case, even when much developer remains in the developing device, a warning indicating that there is no developer is sometimes issued. If the process cartridge is changed according to this warning, a large amount of developer is wasted.

The present invention relates to further improvement of such image forming apparatus and a cartridge which is detachably mountable on the image forming apparatus.

SUMMARY OF THE INVENTION

The present invention has been developed in consideration of the aforementioned problems, and an object thereof is to provide an image forming apparatus in which a residual amount of a developer can accurately be detected and a cartridge which is detachably mountable on the image forming apparatus.

Another object of the present invention is to provide an image forming apparatus comprising:

a developer container for containing a developer;

developer amount detecting means for detecting the amount of the developer contained in the developer container;

a memory;

read/write means for reading and writing information with respect to the memory; and calculating means for calculating the display level of a residual amount of the developer, wherein at least the developer container and the memory are disposed in a unit and the unit is detachably mountable on a main assembly of the image forming apparatus, and the memory stores information indicating that the unit is new, and the calculating means calculates the display level in accordance with "information written into the memory by the read/write means upon detecting the information indicating that the unit is new, and an output of the developer amount detecting means".

Another object of the present invention is to provide an image forming apparatus comprising:

a unit detachably mountable on a main assembly of the image forming apparatus, the unit having a memory and a developer container for containing a developer; and calculating means for calculating a display level of a residual amount of the developer, wherein the memory of the unit that is unused stores information indicating that the unit is new, and the calculating means calculates the display level in accordance with a detected residual amount of the developer and a detected amount of the developer of a point at which the new information is detected.

Still another object of the present invention is to provide a cartridge comprising:

a memory; and a developer container for containing a developer, wherein the memory stores information indicating that the cartridge is new.

Further objects of the present invention will be apparent upon reading the following detailed description with reference to the accompanying drawings.

DETAILED DESCRIPTION OF THE PREFERRED EMBODIMENTS

Figure 1:
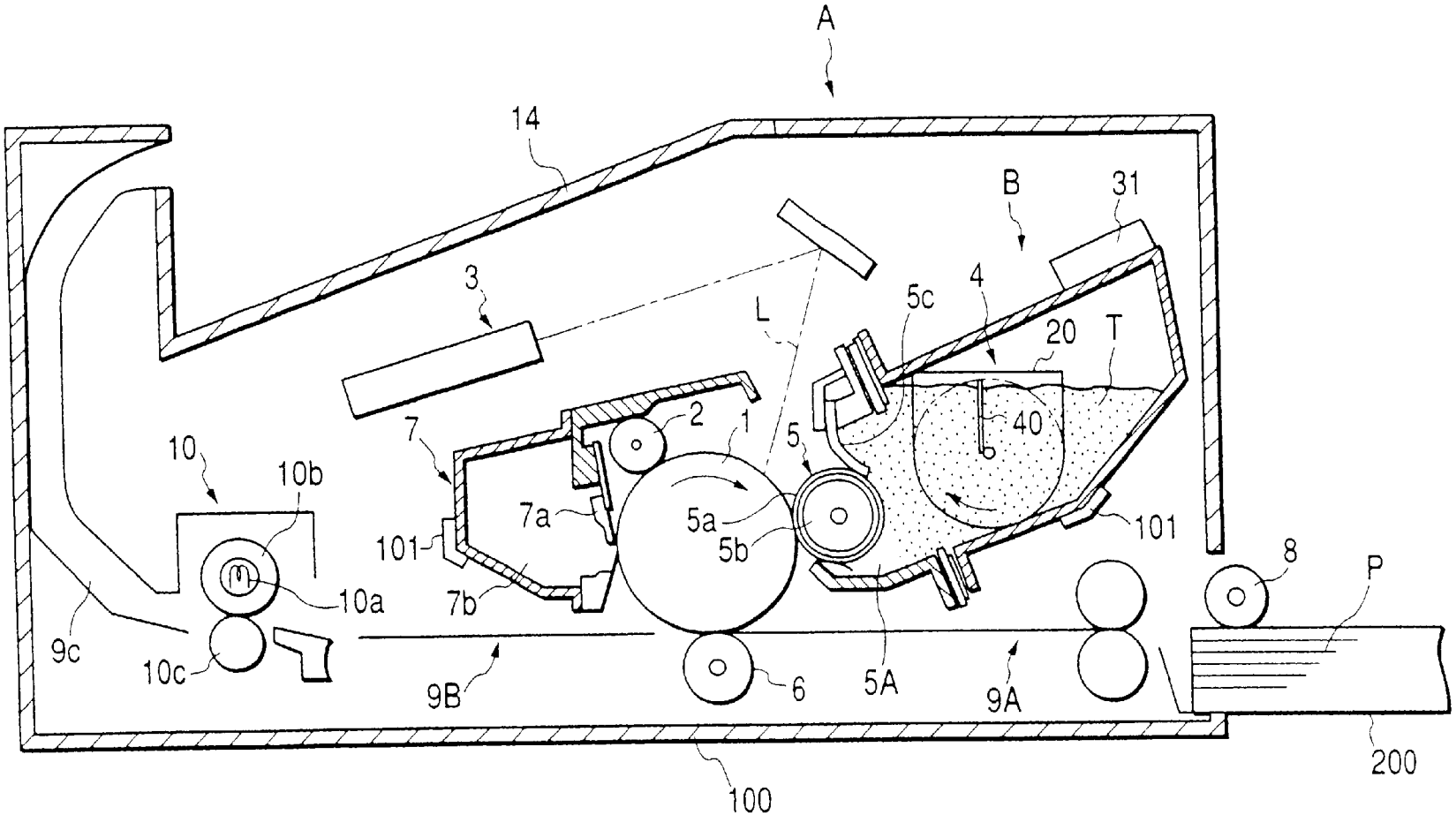
FIG. 1 is a sectional view of an embodiment of a process cartridge and an image forming apparatus according to the present invention.

An image forming apparatus and a cartridge detachably mountable on the image forming apparatus according to the present invention will be described hereinafter in more detail.

First Embodiment

A first embodiment of an electrophotographic image forming apparatus on which a process cartridge is detachably mountable according to the present invention will first be described with reference to FIGS. 1 to 3. In the present embodiment, the electrophotographic image forming apparatus is an electrophotographic laser beam printer A, and an image is formed on recording materials, such as a recording sheet, an OHP sheet, and cloth by an electrophotographic image forming process.

The laser beam printer A is provided with a drum-shaped electrophotographic photosensitive member, that is, a photosensitive drum 1. The photosensitive drum 1 is charged by a charging roller 2 as charging means, and is then irradiated with a laser beam L corresponding to image information from a laser scanner 3, so that a latent image corresponding to the image information is formed on the photosensitive drum 1. The latent image is developed by developing means 5 to form a visualized image, that is, a toner image.

That is to say, the developing means 5 is provided with a developing chamber 5A including a developing roller 5*a* as a developer carrier. A developer T in a developer container 4 as a developer containing section formed to be adjacent to the developing chamber 5A is fed to the developing roller 5*a* of the developing chamber 5A by rotating a developer feeding member 10. In the present embodiment, an insulating one-component toner is used as the developer T. Moreover, a fixed magnet 5*b* is disposed in the developing roller 5*a*. When the developing roller 5*a* is rotated, the developer is carried. A frictional charging load is applied to the developer with a developing blade 5*c*, and the developer is formed into a developer layer with a predetermined thickness and supplied to a developing area of the photosensitive drum 1. The developer supplied to the developing area is transported to the latent image on the photosensitive drum 1 to form a toner image. The developing roller 5*a* is connected to a developing bias circuit, and a developing bias voltage constituted by superposing a direct-current voltage onto an alternating-current voltage is usually applied to the developing roller.

On the other hand, in synchronization with the formation of the toner image, a recording material P set in a supply sheet cassette 200 is conveyed to a transfer position via a pick-up roller 8 and conveying means 9A. In the transfer position, a transfer roller 6 is disposed as transfer means. When voltage is applied to the transfer roller, the toner image on the photosensitive drum 1 is transferred to the recording material P.

The recording material P with the toner image transferred thereto is conveyed to fixing means 10 via conveying means 9B. The fixing means 10 is provided with a fixing roller 10*b* with a heater 10*a* disposed therein and a driving roller 10*c*. When heat and pressure are applied to the recording material P passed through the fixing means, the transferred toner image is fixed on the recording material P.

The recording material P is discharged to a discharge tray 14 via conveying means 9C. The discharge tray 14 is disposed on the top surface of an apparatus main assembly 100 of the laser beam printer A.

For the photosensitive drum 1 from which the toner image has been transferred to the recording material P by the transfer roller 6, the residual developer on the photosensitive drum 1 is removed by cleaning means 7, so that the drum is used for the next image forming process. In the cleaning means 7, the residual developer is scraped off by an elastic cleaning blade 7*a* disposed to abut on the photosensitive drum 1, and collected into a developer reservoir 7*b*.

Figure 2:
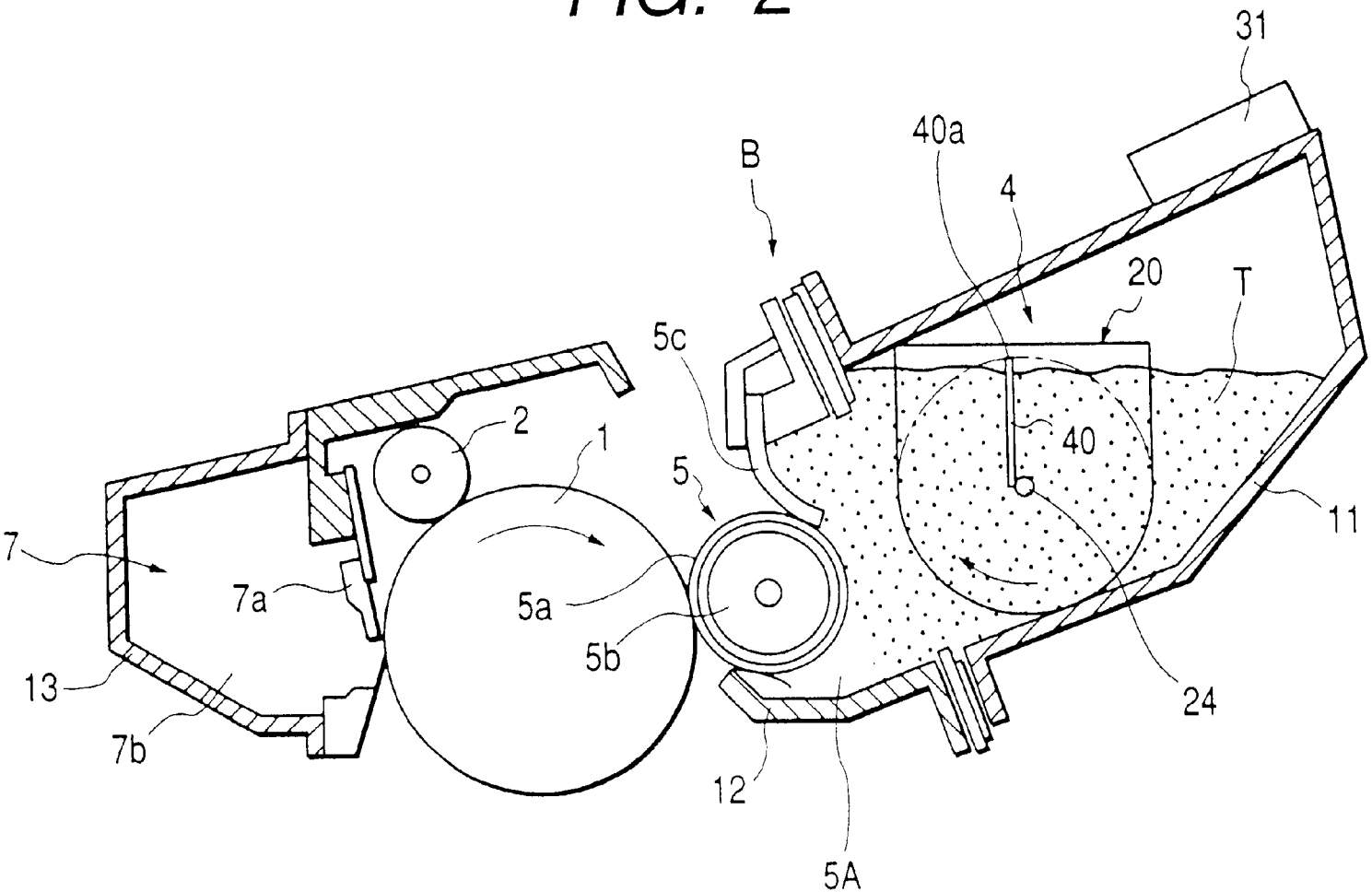
FIG. 2 is an enlarged sectional view of the process cartridge of FIG. 1.

On the other hand, in the present embodiment, for a process cartridge B, as shown in FIG. 2, a developer frame body 11 provided with the developer container (developer containing section) 4 therein and the developer feeding member 10 is integrally welded to a developer frame body 12 in which the developing means 5 such as the developing roller 5*a* and developing blade 5*c* are held to form a developing unit. Furthermore, the developing unit is integrally bonded to a cleaning frame body 13 to which the photosensitive drum 1, the cleaning means 7 such as the cleaning blade 7*a*, and the charging roller 2 are attached, so that the cartridge is formed.

The process cartridge B is detachably mounted on cartridge attachment means 101 (FIG. 1) disposed in the image forming apparatus main assembly 100 by a user.

Figure 4:
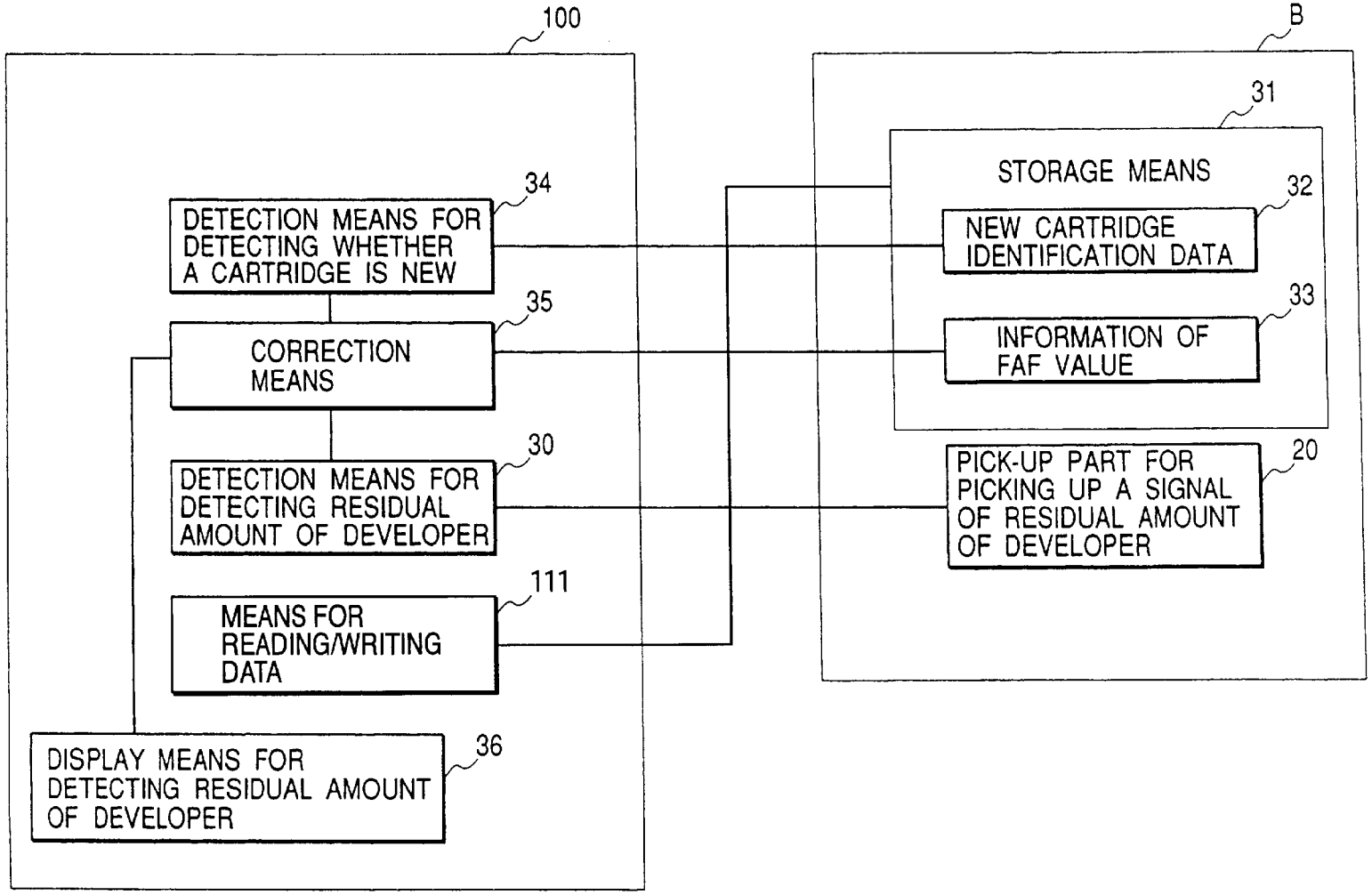
FIG. 4 is a schematic relation diagram of the process cartridge and image forming apparatus according to the embodiment of the present invention.

According to the present invention, as shown in FIG. 4, the process cartridge B is provided with a developer amount detector including: a developer-residual-amount-pick-up part 20 able to successively pick up a developer-residual amount as the developer T in the developer container 4 is consumed; and detection means 30 for detecting the residual amount of the developer.

According to the present embodiment, as described above, in the developer container 4, agitating means 40 is disposed to rotate in an arrow direction of FIG. 1. When the agitating means 40 rotates, the developer T is disentangled, and supplied to the developing roller 5*a*. Moreover, on the inner surface of a side wall of the developer container 4, a flat antenna, that is, a plane antenna 20 is disposed as the developer-residual-amount-pick-up part shown in FIG. 3.

The plane antenna 20 is constituted by forming two electrodes, that is, conductor patterns 22, 23 on a printed substrate 21 for general use through etching or printing. Moreover, to protect a circuit diagram, a protecting film (not shown) is formed on the conductor patterns 22, 23. The conductor patterns may appropriately be set. In the present embodiment, the width (W) of each of two conductor patterns 22, 23 of the plane antenna 20 is set to 300 $\mu$m, and the gap (G) between both conductor patterns 22, 23 is set to be as narrow as about 300 $\mu$m.

In the plane antenna 20 of the present embodiment, an alternating-current bias of 200 Vpp, 2000 Hz was applied to between the conductor pattern electrodes 22, 23. When the developer did not contact the plane antenna 20, 20 pF was observed. When the developer contacted the entire surface of the plane antenna 20, 60 pF was observed. Such different electrostatic capacity values were observed.

When an image forming process is repeated, the developer T in the developer container 4 decreases, the contact area of the developer T with the plane antenna 20 accordingly decreases, and therefore the electrostatic capacity between the electrodes 22, 23 on the plane antenna also decreases. Therefore, the electrostatic capacity can be observed to know the amount of the developer T in the container 4 at any time.

However, in practice, even when the developer T in the container 4 gradually decreases, a slight amount of developer sticks to the plane antenna 20, and this causes a dispersion in the measurement result.

Therefore, to remove the sticking developer from the surface of the antenna, an antenna cleaning member 40*a* (FIG. 2) is disposed on an end portion of the agitating means 40 to clean the surface of the plane antenna 20 as the agitating means 40 rotates. This antenna cleaning member 40*a* is, for example, a polyethylene terephthalate (PFT) sheet, and strokes or cleans the surface of the plane antenna 20.

Figure 3:
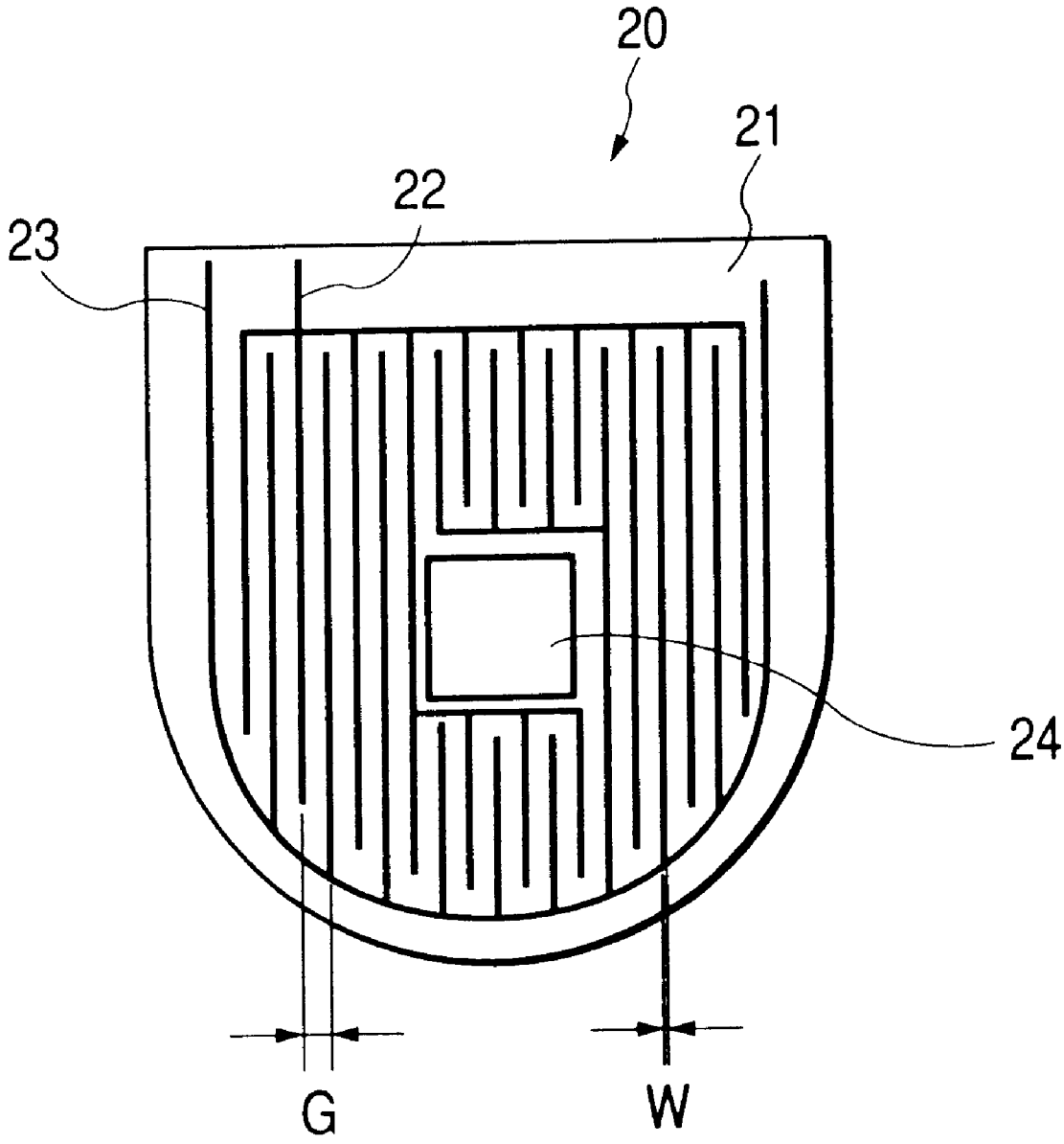
FIG. 3 is a view of a developer residual amount pick-up part mounted on the process cartridge of the present embodiment.

As shown in FIG. 3, a hole 24 is made in a substantially middle portion of the plane antenna 20. When a support shaft of the agitating means 40 is passed through this hole 24 to be rotatably supported in the developer container 4 or the like, the surface cleaning means 40*a* can clean substantially the entire area of the plane antenna 20.

This constitution can substantially cancel measurement-result dispersions caused by a slight amount of remaining developer sticking to the plane antenna 20, but an output of the plane antenna 20 fluctuates with a rotation period of the surface cleaning means 40*a*.

To solve the problem, in the present embodiment, the developer-residual-amount level is defined by taking an average value of the antenna output, selecting a minimum value or performing another statistical processing operation in accordance with the rotation period of the surface cleaning means 40*a*.

In the present embodiment, as understood from FIG. 4, storage means 31 is disposed on a developer container 4 side of the process cartridge B. Moreover, stored in the storage means 31 is new cartridge-identification data 32 hereinafter refered to as "new information" for identifying whether or not the cartridge is new. Furthermore, detection means 34 for detecting whether the cartridge is new is disposed in the image forming apparatus main assembly 100 to identify whether or not the cartridge is new in accordance with the new cartridge identification data 32.

Additionally, in the present embodiment, writable/readable NVRAM is employed in the storage means 31 mounted on the process cartridge B. The image forming apparatus main assembly 100 is provided with means for writing/reading data 111 with respect to the storage means 31. Moreover, an output signal (detected value) from the developer-residual-amount-pick-up part 20 is transmitted to the developer-residual-amount detection means 30, and corrected by correction means 35. Thereafter, the developer-residual amount is defined. The residual amount of the developer is displayed by developer-residual-amount display means 36 disposed in the image forming apparatus main assembly, or a personal computer display (not shown) connected to the image forming apparatus main assembly.

One embodiment of a developer-residual-amount detecting method for accurately detecting the residual amount of the developer in the developer container 4 in the process cartridge and image forming apparatus main assembly constituted as described above will next be described.

Figure 5:
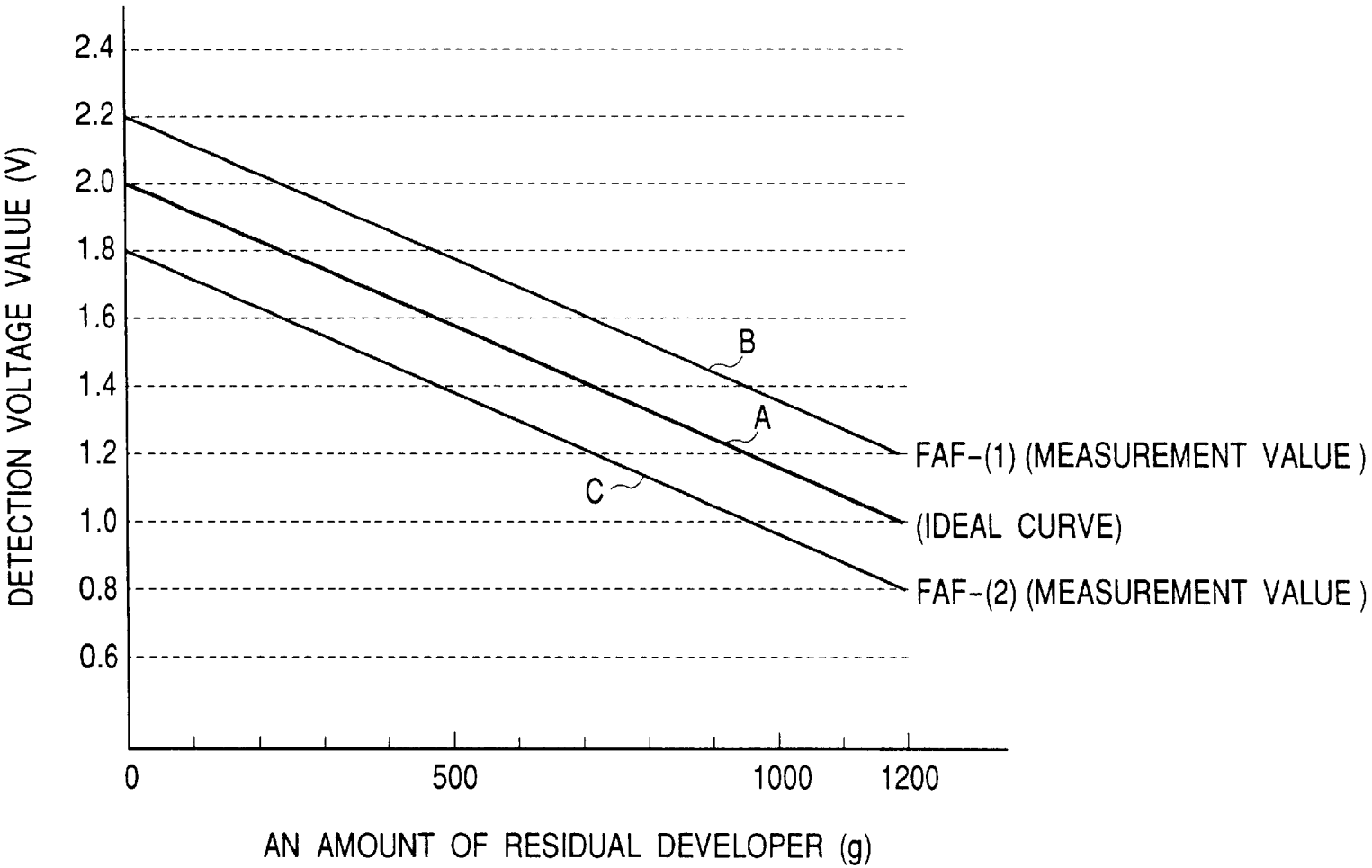
FIG. 5 is a chart showing the relation between a developer residual amount and a detected voltage value.

FIG. 5 is a graph showing the relation between the developer residual amount and an output value of the developer residual amount pick-up part 20 which is the plane antenna.

In this graph, a solid line graph A (ideal curve) is a graph of a point at which each setting is at a design center. The process cartridge B is filled with 1200 g of developer from the first time, and in this case, the plane antenna 20 outputs 1.0 V. The developer amount is in a proportional relation to the output value. The antenna outputs 1.5 V with 600 g of developer, and outputs 2.0 V with 0 g of toner.

However, when deviations of the electrode width and the electrode gap of the plane antenna 20 from the design center, the floating capacity of the process cartridge or the components of the image forming apparatus main assembly, and other tolerances are accumulated, inevitable tolerance is generated in developer-amount measurement.

As a result, graphs B and C shown by broken lines in FIG. 5 show the extent of deviation in the developer-amount measurement.

The graph B of FIG. 5 shows that the tolerance is accumulated and the developer-residual amount less than the actual developer amount is indicated. Conversely, the graph C shows that the developer-residual amount more than the actual developer amount is indicated.

Therefore, in the graph B, when a large amount of printing is to be performed, it is judged that only a small amount of developer remains, the process cartridge is replaced with a new one, and the developer is wastefully discarded. Moreover, in the graph C, the developer becomes short midway during printing, and only a part of the image is printed. If there is an error in the developer-amount measurement in this manner, the developer is wasted.

To solve the present invention, immediately after a new process cartridge is disposed in the image forming apparatus main assembly, the output value (hereinafter referred to as flat antenna full (FAF)) of the plane antenna 20 is stored in the storage means 31. When the detected value of the residual amount of the developer is corrected and the residual amount of the developer is displayed based on the FAF, the residual amount of the developer can be displayed with a higher precision as compared with the conventional art.

For example, when FAF is 1.2 V, the residual amount of the developer is determined from a detected voltage value according to the linear graph B. Moreover, when FAF is 0.8 V, the residual amount of the developer is determined from the detected voltage value according to the linear graph C.

That is to say, when FAF=X(V) is detected, and it is then assumed that the residual amount of the developer=Y(g), the detected voltage value=Z(V), the following processing is performed.

$$Y=1200\cdot(1-Z+X) \quad (1)$$

A value of Y is displayed in the developer-residual-amount display means 36 or the display of the computer connected to the image forming apparatus. This processing is performed by the correction means 35.

Figure 6:
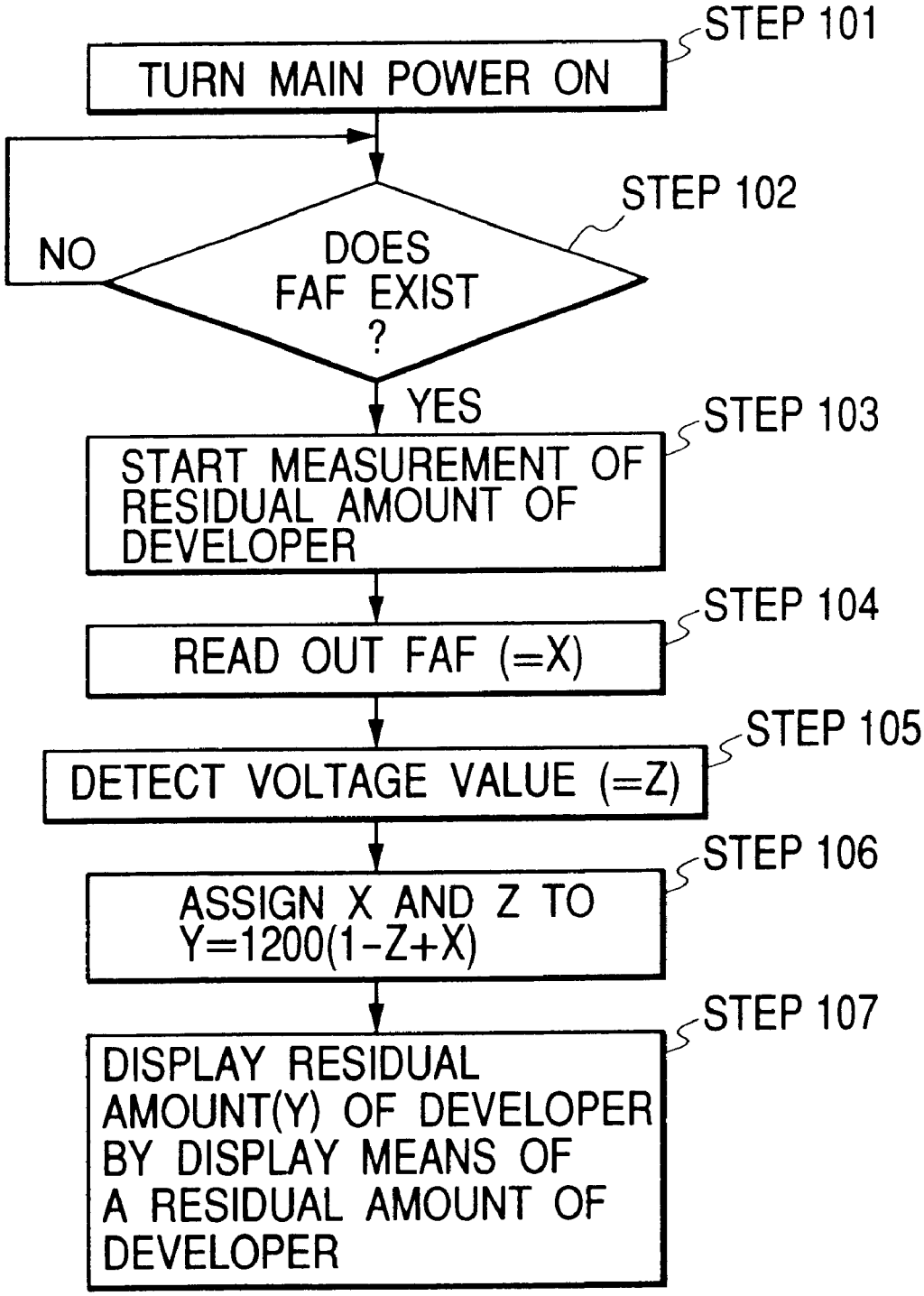
FIG. 6 is a flowchart showing the developer amount detecting method according to the present invention.

A method of correcting the detected value of the residual amount of the developer in accordance with the FAF will be described with reference to a flowchart of FIG. 6.

After turning the main power on (step 101), it is judged by the correction means 35 whether or not information of the FAF value 33 exists in the storage means 31 (step 102). When it is judged that the FAF value information 33 exists, the measurement of the residual amount of the developer is started (step 103), FAF is read out by the correction means 35 (step 104), and the detected value of the residual amount of the developer is read out from the developer-residual-amount pick-up part 20 (step 105). Subsequently, the correction means 35 assigns the detected voltage value of FAF to the above equation (1) (step 106). The resulting value, that is, the residual amount of the developer is displayed by the developer-residual-amount display means 36.

For example, when FAF is determined as 1.2 V, and the detected voltage value is 1.7 V, X=1.2, Z=1.7 are assigned to the above equation (1), and Y=600 (g) results.

According to the present invention, the residual amount of the developer can be displayed in consideration of not only the dispersions of the plane antenna 20 such as manufacturing tolerance, and mounting tolerance, but also the dispersions of the process cartridge and image forming apparatus main assembly.

Figure 7:
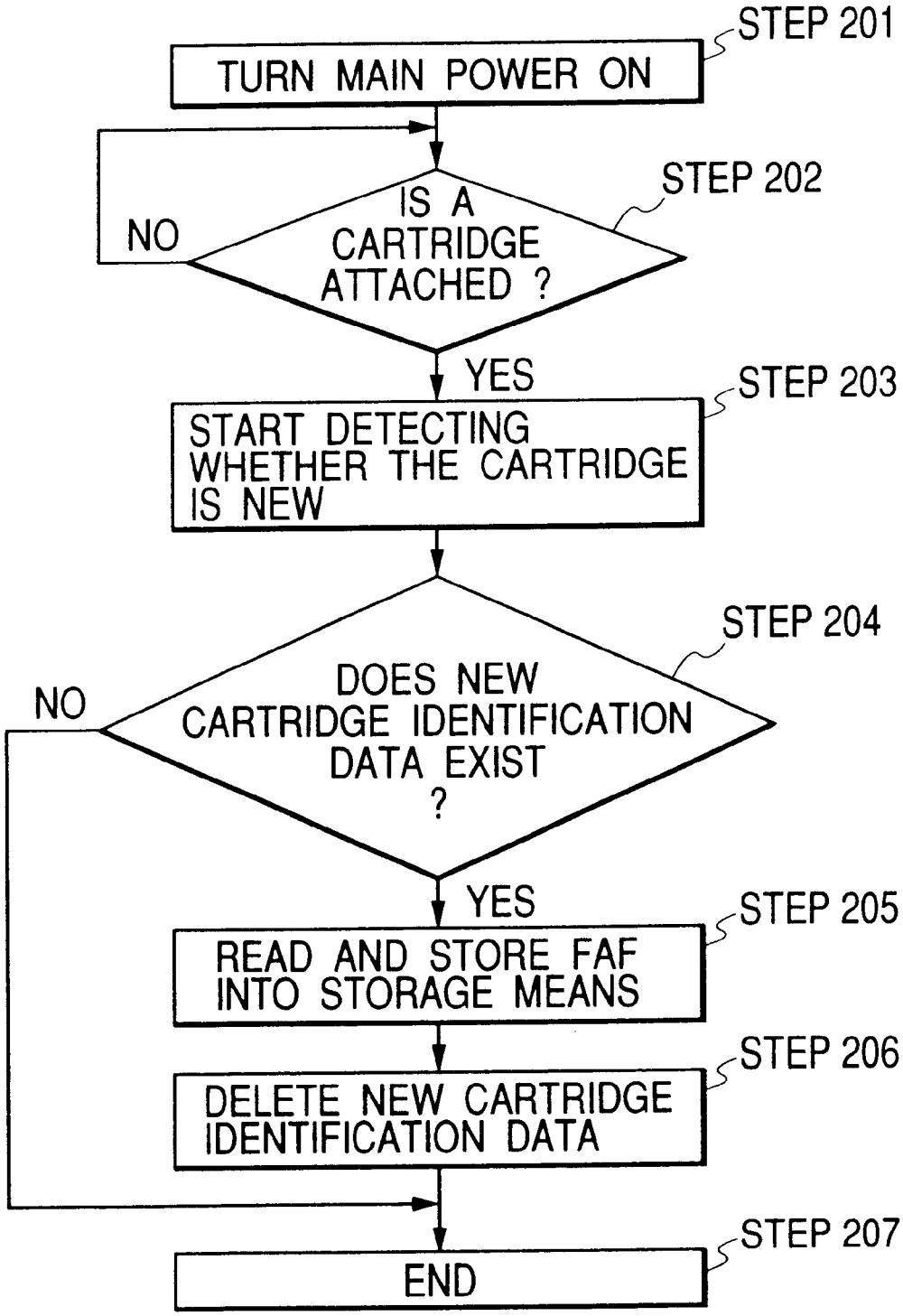
FIG. 7 is a flowchart showing an embodiment of a method for determining a detected value (FAF) of a developer-residual amount of a point at which a container is full of developer according to the present invention.

A sequence for determining FAF will be described hereinafter with reference to a flowchart of FIG. 7.

First, immediately after turning the main switch on (step 201), it is detected whether or not the process cartridge is attached to the image forming apparatus main assembly 100 (step 202). Here, when it is detected that the process cartridge is attached to the main assembly, it starts to be detected whether or not the process cartridge is new (step 203). When it is detected that no process cartridge is attached, this processing flow does not advance to a step for detecting new information, that is, whether or not the cartridge is new. Instead, it is detected again whether or not the process cartridge exists (step 202).

Subsequently, the detecting means for detecting whether the cartridge is new detects whether the new cartridge-identification data 32 exists in the storage means 31 (step 204).

As a result, when the new cartridge detection means 34 detects that the new cartridge identification data 32 is stored in the storage means 31, the developer-residual-amount detection means 30 reads a detected value from the developer-residual-amount-pick-up part 20. This detected value is written as the FAF value information 33 into the storage means 31 by the correction means 35 (step 205). Simultaneously or subsequently, the new cartridge identification data 32 is deleted (step 206).

Since the new cartridge-identification data 32 is deleted, the FAF value information 33 can be prevented from being written into the process cartridge with the new cartridge identification data 32 deleted therefrom, and false detection of the FAF can be prevented.

Moreover, the new cartridge-identification data 32 is deleted after the FAF value information 33 is written. If this order is reversed, that is, the new cartridge-identification data 32 is deleted before writing the FAF value information 33, because of some trouble, the new cartridge-identification data 32 is deleted without writing the FAF value information 33. When such situation occurs, it is impossible to write the FAF value information 33 into the process cartridge. Therefore, it is impossible to attain an object of detecting the accurate residual amount of the toner in the present embodiment.

After the new cartridge identification data 32 is deleted, the sequence ends (step 207).

Moreover, when it is detected in the step 204 that the new cartridge-identification data 32 does not exist in the storage means 31, the sequence ends (step 207). Moreover, the new cartridge-identification data 32 is a semiconductor memory, but this is not limited to this. After the data is once used as the new cartridge-identification data, the data has no function of the new cartridge identification data. For such data, for example, a fuse may arbitrarily be used.

Through the aforementioned sequence for determining FAF, the FAF value information 33 is accurately and securely written into the storage means 31, and the FAF can be prevented from being written into the storage means by false detection. Therefore, this sequence can contribute to accurate detection of the residual amount of the developer.

As described above, according to the present invention, the residual amount of the toner can be displayed in consideration of not only the dispersion of the plane antenna but also the dispersions of the process cartridge and image-forming-apparatus main assembly. Furthermore, the new cartridge-identification data 32 is used to determine FAF, and the FAF value information 33 is written into the storage means 31. Simultaneously or subsequently, the new cartridge identification data 32 can easily be deleted. Therefore, the false detection of FAF is prevented, and more accurate toner residual amount can be displayed.

In the present embodiment, the plane antenna type is used as the developer-residual-amount-pick-up part 20. In the present invention, however, the developer residual amount pick-up part is not limited to this type. An agitation-torque detection type disposed in the developer container 4 and any other type may be used as long as the residual amount of the developer can be detected.

Second Embodiment

Figure 8:
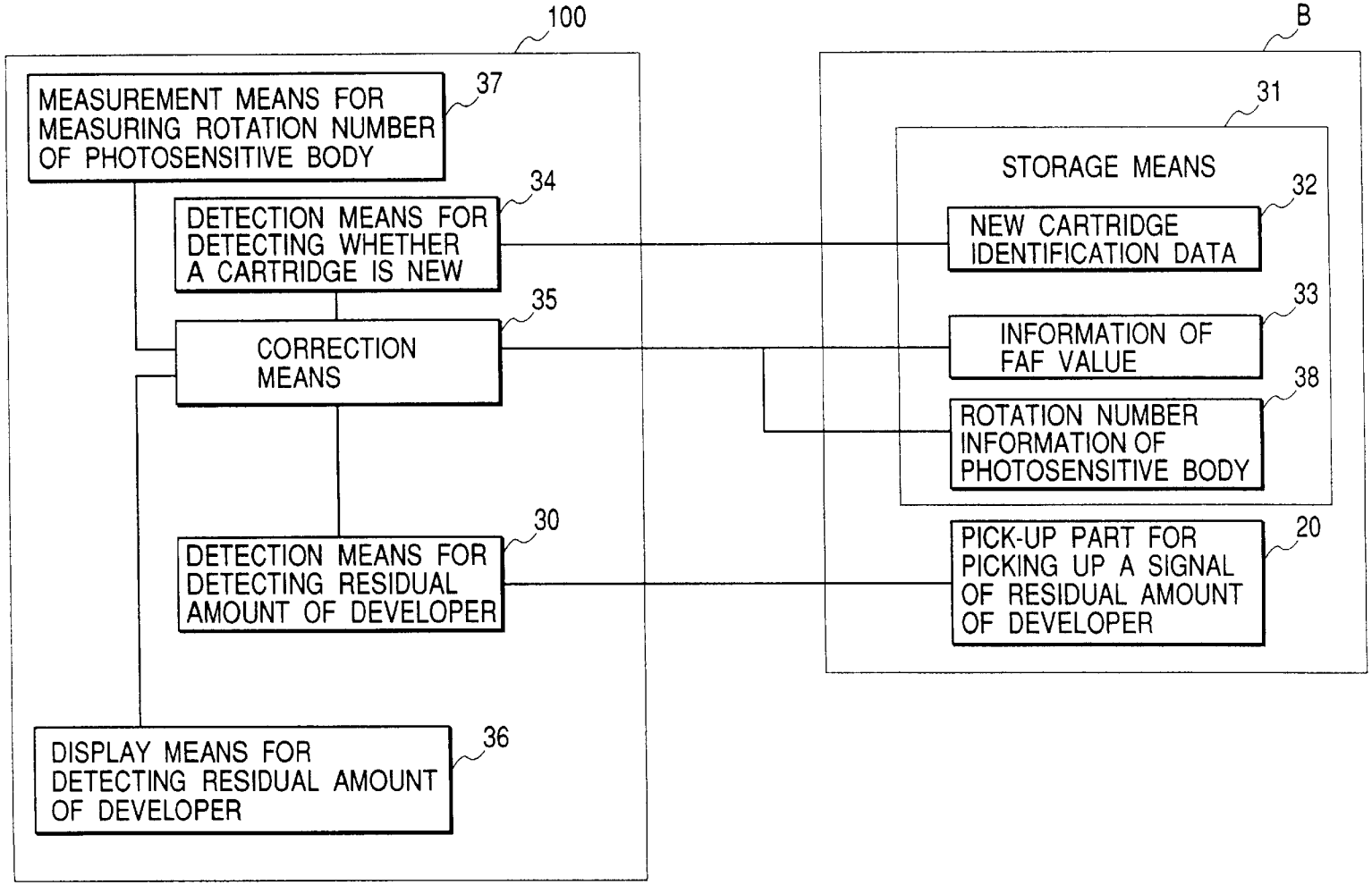
FIG. 8 is a schematic relation diagram of the process cartridge and image forming apparatus according to another embodiment of the present invention.
Figure 9:
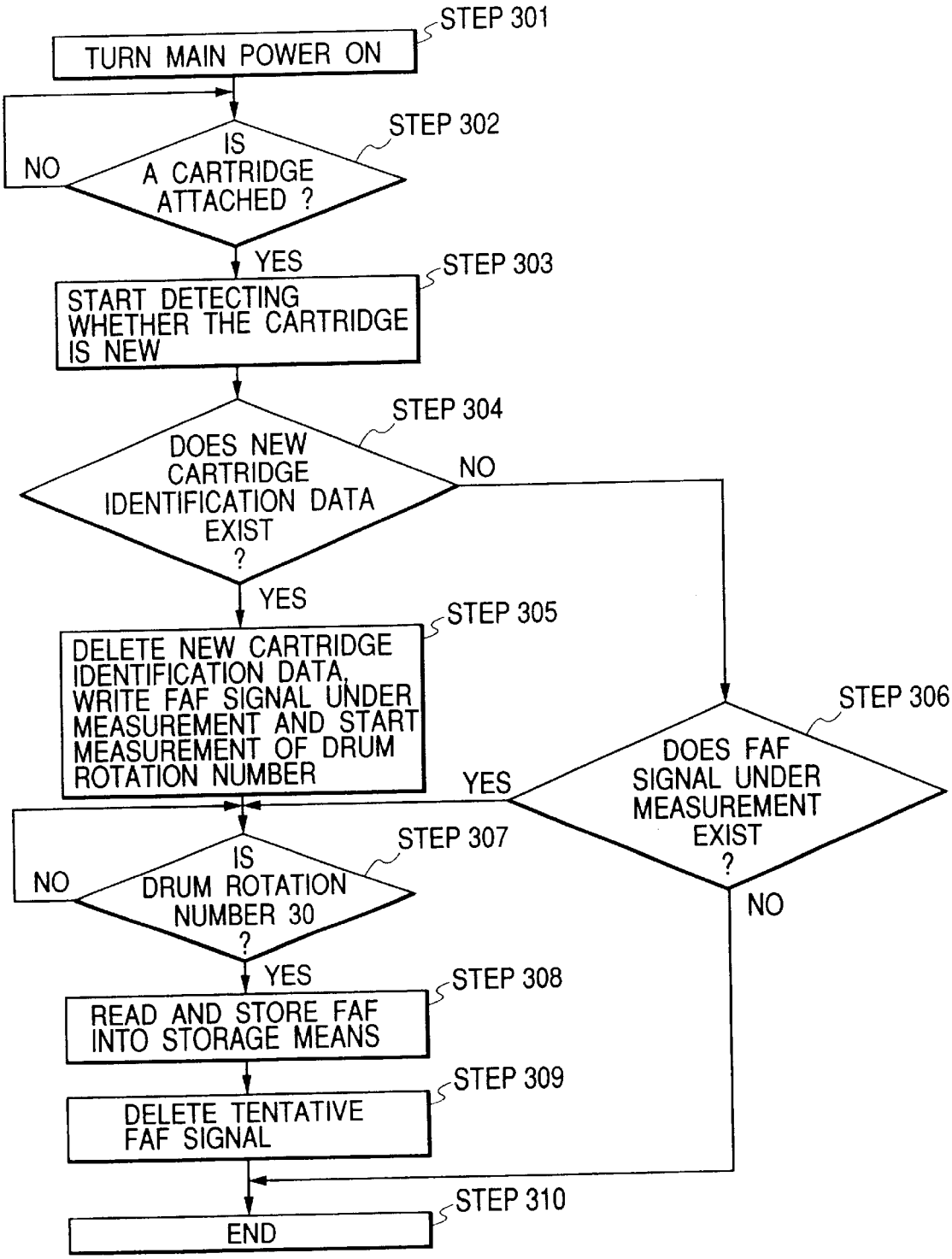
FIG. 9 is a flowchart showing another embodiment of the method for determining the detected value (FAF) of the developer-residual amount of the point at which the container is full of developer according to the present invention.

In a second embodiment, the same plane antenna 20 as described above is used in the same process cartridge B and image forming apparatus as described in the first embodiment, but the sequence for determining the FAF is changed. The second embodiment will be described hereinafter with reference to FIGS. 8 and 9.

For the sequence for determining the FAF in the first embodiment, immediately after the new cartridge-identification data 32 is detected, the FAF is determined. In the second embodiment, however, the FAF is determined after the new cartridge-identification data 32 is detected and a predetermined operation is performed. That is to say, the FAF is determined, for example, after the photosensitive drum 1 rotates by a predetermined rotation number, for example, 30 times. Concretely, when the new cartridge detection means 34 detects the new cartridge identification data 32, measurement means 37 for measuring the rotation number of the photosensitive body measures the rotation number of the photosensitive body. When the rotation number of the photosensitive body measures 30 rotations, the FAF is determined. This secures a predetermined number of toner agitating operations. Therefore, during the agitation, inclination of the developer in the developer container 4 can be made uniform, and this can contribute to more accurate FAF determination.

A method of correcting the residual amount of the developer in the second embodiment is similar to the method described in the first embodiment. The sequence for determining the FAF in the second embodiment will next be described with reference to a flowchart of FIG. 9.

The procedure of steps 301 to 304 in the second embodiment is similar to the procedure of the first embodiment, and the description thereof is therefore omitted.

When the new cartridge-detection means 34 detects the new cartridge-identification data 32 in the step 304, the new cartridge-identification data 32 in the storage means 31 is deleted. Simultaneously, a FAF signal is measured, and written as a tentative FAF signal into the storage means 31, and the photosensitive body rotation number measurement means 37 starts measuring the rotation number of the photosensitive drum I (step 305). In this case, a measured value of rotation number is written as rotation-number information 38 of the photosensitive body into the storage means 31 by the correction means 35.

Subsequently, when the correction means 35 detects that the stored photosensitive-body-rotation-number value reaches 30, the correction means 35 reads FAF by the developer-residual-amount-pick-up part 20, and writes FAF into the storage means 31 (step 308). Simultaneously, the correction means 35 deletes the tentative FAF signal from the storage means 31 (step 309). Thereafter, the sequence ends (step 310).

Here, the tentative FAF signal is stored in the storage means 31. After the new cartridge-identification data 32 is deleted in the step 304, the process cartridge is detached from the image forming apparatus main assembly before determining FAF in the step 308. In this case, even when the process cartridge is again inserted into the main assembly, the sequence for determining the FAF does not operate, but this disadvantage is prevented according to the present embodiment.

Therefore, even when it is judged that the new cartridge-identification data 32 does not exist, it is subsequently judged whether or not the FAF signal under measurement exists (step 306). When the FAF signal under measurement exists, the rotation number of the photosensitive drum is detected (step 307), and the FAF is determined as a final value (step 308).

For the new cartridge-identification data 32, besides the semiconductor memory, a fuse, and any other means which has no function as the new cartridge-identification data after being used as the new cartridge-identification data may be used similarly as the first embodiment.

According to the present embodiment, through the aforementioned sequence for determining the FAF, the FAF value information 33 is accurately and securely written into the storage means 31, the FAF value information 33 is prevented from being written by the false detection, and the present embodiment can contribute to the accurate detection of the residual amount of the developer similarly-as the first embodiment. Furthermore, according to the present embodiment, after the process cartridge is attached to the image forming apparatus main assembly, the developer in the developer container is securely agitated only by a predetermined number of times. Therefore, if the user tilts the process cartridge during attachment, or for other reasons the developer locally exists in the developer container, the toner can uniformly be leveled, and the FAF can more accurately be detected.

In the present embodiment, the plane-antenna type is used as the developer-residual-amount-pick-up part 20, but the present invention is not limited to this type of developer-residual-amount-pick-up part. The conventional agitation-torque-detection type disposed in the developer container and any other arbitrary type known to a person skilled in the art may be used as far as the residual amount of the developer can be detected, similarly as the first embodiment.

Third Embodiment

Figure 10:
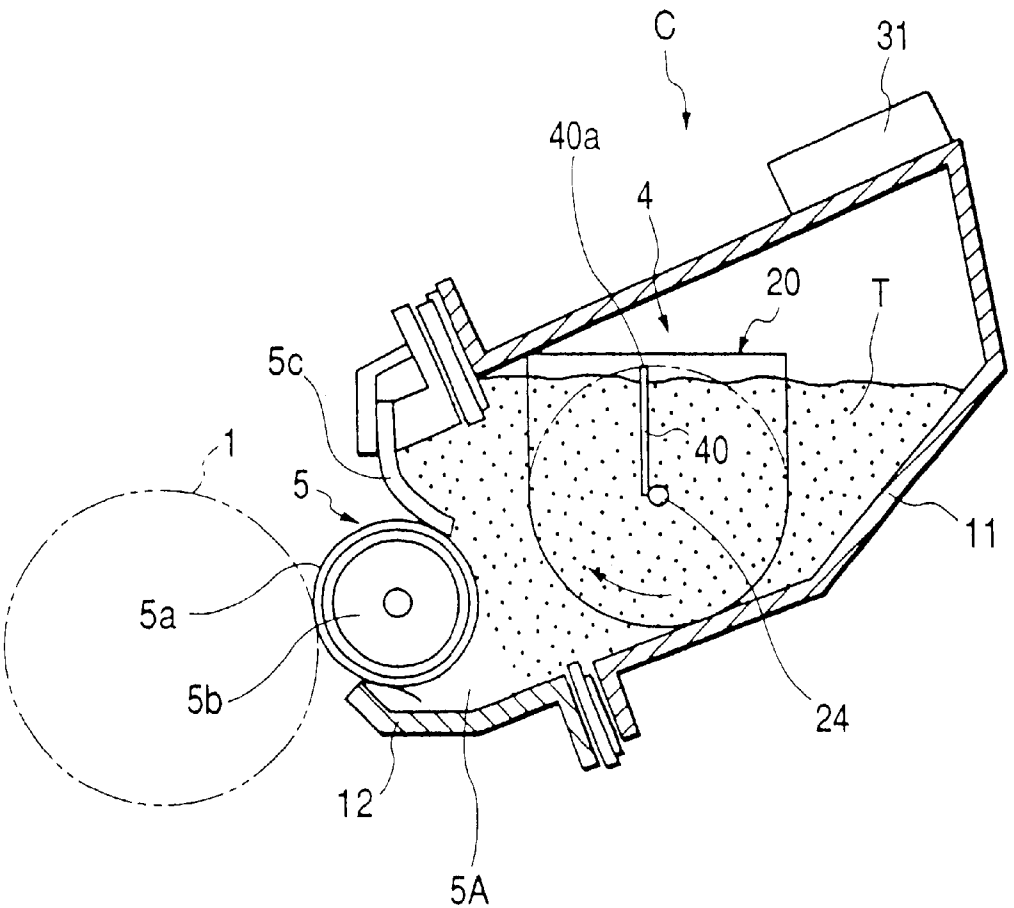
FIG. 10 is a sectional view showing one embodiment of a cartridge developing device according to the present invention.

FIG. 10 shows one embodiment of a cartridge developing device C according to the present invention.

The developing device C is provided with the developing roller 5*a* or another developer carrier, and the developing chamber 5A in which the toner is contained to supply the developer to the developer carrier, and is integrally formed as a cartridge by the plastic developing frame bodies 11, 12. That is to say, in the developing device C of the present embodiment, the developing device constituting sections of the process cartridge B described in the first embodiment is formed as a unit. The developing device can be considered as the integral cartridge formed by excluding the photosensitive drum 1, the charging means 2, and the cleaning means 7 from the process cartridge B. Therefore, all the constitutions of the developing device and developer-amount-detection means described in the first and second embodiments are also applied to the developing device of the third embodiment. Therefore, the description of the constitution and action of the first and second embodiments can also be applied to those of the third embodiment.

Even in the third embodiment, the action and effect similar to those of the first and second embodiments can be achieved.

The present invention is not limited to the aforementioned embodiments, and includes modifications of the same technical concept.

What is claimed is:

1. A unit detachably mountable on an image forming apparatus, comprising:

a memory;

a developer container for containing a developer; and developer amount detecting means for detecting an amount of the developer contained in said developer container, wherein said memory includes a first memory portion for storing information identifying whether or not said unit is new and a second memory portion for storing a detected value detected by said developer amount detecting means according to information stored in said first memory portion.

2. A unit according to claim 1, wherein information identifying whether or not said unit is new is read out from said memory by read/write means of said apparatus.

3. A unit according to claim 2, wherein said second memory portion stores the detected value when the information indicates that said unit is new.

4. A unit according to claim 1, further comprising at least one of an image bearing member, developing means for supplying the developer to said image bearing member and cleaning means for cleaning the image bearing member.

5. An image forming apparatus comprising:

a developer container for containing a developer;

developer amount detecting means for detecting an amount of the developer contained in said developer container;

correction means for correcting a detected value detected by said developer amount detecting means; and a memory;

wherein at least said developer container and said memory are disposed in a unit and said unit is detachably mountable on a main assembly of said image forming apparatus, wherein said memory stores information identifying whether or not said unit is new, and wherein said correction means corrects a next detected value to be detected by said developer amount detecting means according to the detected value detected by said developer amount detecting means when the information indicates that said unit is new.

6. An image forming apparatus according to claim 5, further comprising read/write means for reading and writing information with respect to said memory, wherein, said read/write means deletes information identifying that said unit is new.

7. An image forming apparatus according to claim 5, further comprising read/write means for reading and writing information with respect to said memory, wherein said read/write means writes the detected value into said memory.

8. An image forming apparatus according to claim 7, wherein said read/write means writes the detected value into said memory immediately after said the information indicates that said unit is new.

9. An image forming apparatus according to claim 7, wherein said read/write means writes the detected value into said memory after elapse of a predetermined time from when the information indicates that said unit is new.

10. An image forming apparatus according to claim 9, further comprising an image bearing member, wherein the predetermined time is measured in accordance with a rotation number of said image bearing member.

11. An image forming apparatus according to claim 9, further comprising agitating means for agitating the developer in said container, wherein the predetermined time corresponds to an operating time of said agitating means.

12. An image forming apparatus according to claim 9, wherein said read/write means writes information indicating that an amount of developer is being measured by said developer amount detecting means into said memory immediately after the information indicates that said unit is new.

13. An image forming apparatus according to claim 12, wherein when said read/write means writes the detected value into said memory, the read/write means deletes information indicating that an amount of developer is being measured by said developer anoint detecting means.

14. An image forming apparatus according to claim 9, wherein said read/write means deletes the information after the information indicates that said unit is new.

15. An image forming apparatus according to claim 5, further comprising means for display, wherein the detected value corrected by said correction means is displayed in said means for display.

16. An image forming apparatus according to claim 5, further comprising output means for outputting the detected value corrected by said correction means to an external apparatus, the detected value being displayed in a display of the external apparatus.

17. An image forming apparatus according to claim 5, wherein said unit further holds said developer amount detecting means.

18. An image forming apparatus according to claim 5, wherein said unit further comprises at least one of an image bearing member, developing means for supplying the developer to said image bearing member and cleaning means for cleaning said image bearing member.

19. A memory device to be mounted on a unit usable with an image forming apparatus which includes an image bearing member, charging means, developing means having a developer container, and developer amount detecting means for detecting an amount of the developer contained in the developer container, said memory device comprising:

a first memory portion for storing information identifying whether or not the unit is new, and a second memory portion for storing a detected value detected by the developer amount detecting means according to information stored in said first memory portion.

20. A memory device according to claim 19, wherein said second memory portion stores the detected value when the information stored in said first memory portion indicates that the unit is new.

21. A memory device according to claim 19, further comprising a third memory portion for storing information relating to a rotation number of the image bearing member.

22. A memory device according to claim 19, wherein said memory device can store information indicating that an amount of developer is being measured by the developer amount detecting means according to the information stored in said first memory portion.

* * * * *

UNITED STATES PATENT AND TRADEMARK OFFICE

CERTIFICATE OF CORRECTION

PATENT NO. : 6,621,989 B2
DATED : September 16, 2003
INVENTOR(S) : Yasunao Otomo et al.

It is certified that error appears in the above-identified patent and that said Letters Patent is hereby corrected as shown below:

Column 5,
Line 10, “fixing” should read -- the fixing --.

Column 10,
Line 4, “a FAF” should read -- an FAF --.
Line 47, “similarly-as” should read -- similarly as --.

Column 12,
Line 15, “after said” should read -- after --.
Line 38, “anoint” should read -- amount --.

Signed and Sealed this

Thirtieth Day of March, 2004

JON W. DUDAS
*Acting Director of the United States Patent and Trademark Office*